US008944163B2

(12) United States Patent
Parsche

(10) Patent No.: US 8,944,163 B2
(45) Date of Patent: Feb. 3, 2015

(54) METHOD FOR HYDROCARBON RECOVERY USING A WATER CHANGING OR DRIVING AGENT WITH RF HEATING

(71) Applicant: Harris Corporation, Melbourne, FL (US)

(72) Inventor: Francis E. Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 250 days.

(21) Appl. No.: 13/650,342

(22) Filed: Oct. 12, 2012

(65) Prior Publication Data

US 2014/0102692 A1 Apr. 17, 2014

(51) Int. Cl.
*E21B 43/24* (2006.01)

(52) U.S. Cl.
USPC ..... 166/272.7

(58) Field of Classification Search
USPC ..... 166/272.1, 272.3, 272.7
See application file for complete search history.

(56) References Cited

U.S. PATENT DOCUMENTS

| | | | | |
|---|---|---|---|---|
| 3,981,958 | A | 9/1976 | Nakashima et al. | |
| 5,046,559 | A | 9/1991 | Glandt | |
| 5,056,596 | A | 10/1991 | McKay et al. | |
| 6,375,634 | B1 | 4/2002 | Carroll | |
| 6,530,577 | B1 | 3/2003 | Busby et al. | |
| 6,695,320 | B2 | 2/2004 | Busby et al. | |
| 6,872,560 | B1 | 3/2005 | Yue et al. | |
| 6,883,607 | B2 | 4/2005 | Nenniger et al. | |
| 7,214,788 | B2 | 5/2007 | Guzov et al. | |
| 7,229,516 | B2 | 6/2007 | Busby et al. | |
| 7,399,904 | B2 | 7/2008 | Shirley | |
| 7,527,096 | B2 | 5/2009 | Chung et al. | |
| 7,655,838 | B2 | 2/2010 | Guzov et al. | |
| 7,717,175 | B2 | 5/2010 | Chung et al. | |
| 7,718,788 | B2 | 5/2010 | Sharma et al. | |
| 7,795,415 | B2 | 9/2010 | Shirley et al. | |
| 7,798,221 | B2 | 9/2010 | Vinegar et al. | |
| 2007/0187089 | A1 | 8/2007 | Bridges | |
| 2007/0261844 | A1 | 11/2007 | Cogliandro et al. | |
| 2008/0073079 | A1 | 3/2008 | Tranquilla et al. | |
| 2010/0078163 | A1 | 4/2010 | Banerjee et al. | |
| 2010/0276148 | A1 | 11/2010 | Wylie et al. | |
| 2010/0294488 | A1* | 11/2010 | Wheeler et al. | 166/248 |
| 2010/0294489 | A1 | 11/2010 | Dreher, Jr. et al. | |
| 2013/0048297 | A1* | 2/2013 | Parsche et al. | 166/369 |
| 2014/0041890 | A1* | 2/2014 | Wright et al. | 174/19 |

* cited by examiner

*Primary Examiner* — William P Neuder
(74) *Attorney, Agent, or Firm* — Allen, Dyer, Doppelt, Milbrath & Gilchrist, P.A.

(57) ABSTRACT

A method of processing a hydrocarbon resource in a subterranean formation including a laterally extending injector well, a laterally extending producer well below the laterally extending injector well, and water within the subterranean formation, may include injecting a water changing agent into the laterally extending injector well to change the water in the subterranean formation adjacent the injector well to absorb less RF power. The method may also include applying RF power to an RF radiator within the injector well after injection of the water changing agent, and recovering hydrocarbon resources from the laterally extending producer well. In another embodiment, the method may include injecting a water driving agent into the laterally extending injector well.

33 Claims, 10 Drawing Sheets

METHOD FOR HYDROCARBON RECOVERY USING A WATER CHANGING OR DRIVING AGENT WITH RF HEATING

FIELD OF THE INVENTION

The present invention relates to the field of hydrocarbon resource recovery, and, more particularly, to hydrocarbon resource recovery using RF heating.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated in-situ to reduce its viscosity and mobilize the oil flow. In SAGD, pairs of injector and producer wells are formed to be laterally extending in the ground. Each pair of injector/producer wells includes a lower producer well and an upper injector well. The injector/producer wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same affect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

Unfortunately, long production times to extract oil using SAGD may lead to significant heat loss to the adjacent soil, excessive consumption of steam, and a high cost for recovery. Moreover, there may be an insufficient amount of caprock to contain the steam, and surface water resources may be limited. It thus may be desirable to use conducted heating initially to soften the subterranean formation to establish convective flow to convey the steam. However, conducted heating is relatively slow and unreliable. Also, many SAGD wells fail to start, and SAGD may be impractical in permafrost areas due to melting at the surface.

Radio frequency heating is one approach for enhanced oil recovery (EOR). In radio frequency heating, electric fields and magnetic fields may be applied to a subterranean formation using an underground antenna. Radio frequency heating has the advantage of increased speed compared to steam.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294489 to Wheeler et al. discloses a similar approach.

U.S. Pat. No. 5,046,559 to Glandt discloses a method for producing oil from tar sands by electrically preheating paths of increased injectivity between an injector well and a pair of producer wells arranged in a triangular pattern. The paths of increased injectivity are then steam flooded to produce the hydrocarbon resources.

Unfortunately, SAGD may not efficiently permit recovery of the hydrocarbon resources in that SAGD may have increased capital and energy costs, for example, as disclosed in U.S. Patent Application Publication No. 2010/0276148 to Wylie et al. Wylie et al. discloses combusting a fuel mixture so that combustion gases with relatively high levels of carbon dioxide, steam, and/or hot water are used to improve recovery of heavy hydrocarbons. In particular, a gas, fluid water, and carbon dioxide are delivered to the heavy hydrocarbon material. The gas may be heated by microwave RF heating. Still, further efficiency in hydrocarbon recovery may be desired.

SUMMARY OF THE INVENTION

In view of the foregoing background it is therefore an object of the present invention to provide a method for more efficiently recovering hydrocarbon resources from a subterranean formation while potentially using less energy and providing faster recovery of the hydrocarbons.

These and other objects, features and advantages of the present invention are provided by a method of processing a hydrocarbon resource in a subterranean formation including a laterally extending injector well, a laterally extending producer well below the laterally extending injector well, and water within the subterranean formation. The method includes injecting a water changing agent into the laterally extending injector well to change the water in the subterranean formation adjacent the injector well to absorb less RF power. The method also includes applying RF power to an RF radiator within the injector well after injection of the water changing agent, and recovering hydrocarbon resources from the laterally extending producer well. Accordingly, hydrocarbon resources may be more efficiently recovered. For example, the radial penetration depth of the RF power into a subterranean formation may be more quickly increased.

Injecting the water changing agent comprises injecting the water changing agent to change the water so that a conductivity of the subterranean formation adjacent the injector well is preferably reduced to below 0.0002 mhos/meter for a radius of at least 10 meters, and more preferably reduced to below 0.00002 mhos/meter for a radius of at least 30 meters.

Injecting the water changing agent may include injecting an emulsifying agent. Injecting the emulsifying agent may include injecting at least one of a glycol and a detergent, for example.

Injecting the water changing agent may include injecting a freezing agent. Injecting the freezing agent comprises injecting carbon dioxide, for example.

The method may further include coupling an RF source to the RF radiator above the subterranean formation. Recovering the hydrocarbon resources may include injecting steam into the laterally extending injector well, and recovering hydrocarbon resources from the laterally extending producer well, for example.

Another aspect is directed to a method of processing a hydrocarbon resource in a subterranean formation that includes a laterally extending injector well, a laterally extending producer well below the laterally extending injector well, and water within the subterranean formation. The method includes injecting a water driving agent into the laterally extending injector well to drive water in the subterranean formation away from the laterally extending injector well. The method further includes applying RF power to an RF radiator within the laterally extending injector well after injection of the water driving agent, and recovering hydrocarbon resources from the laterally extending producer well.

Injecting the water driving agent may include injecting the water driving agent to drive the water so that a conductivity of the subterranean formation adjacent the injector well is preferably reduced to below 0.0002 mhos/meter for a radius of at least 10 meters, and more preferably to below 0.00002 mhos/meter for a radius of at least 30 meters. Injecting the water driving agent may include injecting a light hydrocarbon, for example, at least one of propane and nitrogen. Injecting the water driving agent may include injecting a dry gas, for example, nitrogen.

The method may further include coupling an RF source to the RF radiator above the subterranean formation. The method may further include injecting steam into the injector well.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to indicate similar elements in alternative embodiments.

Figure 1:
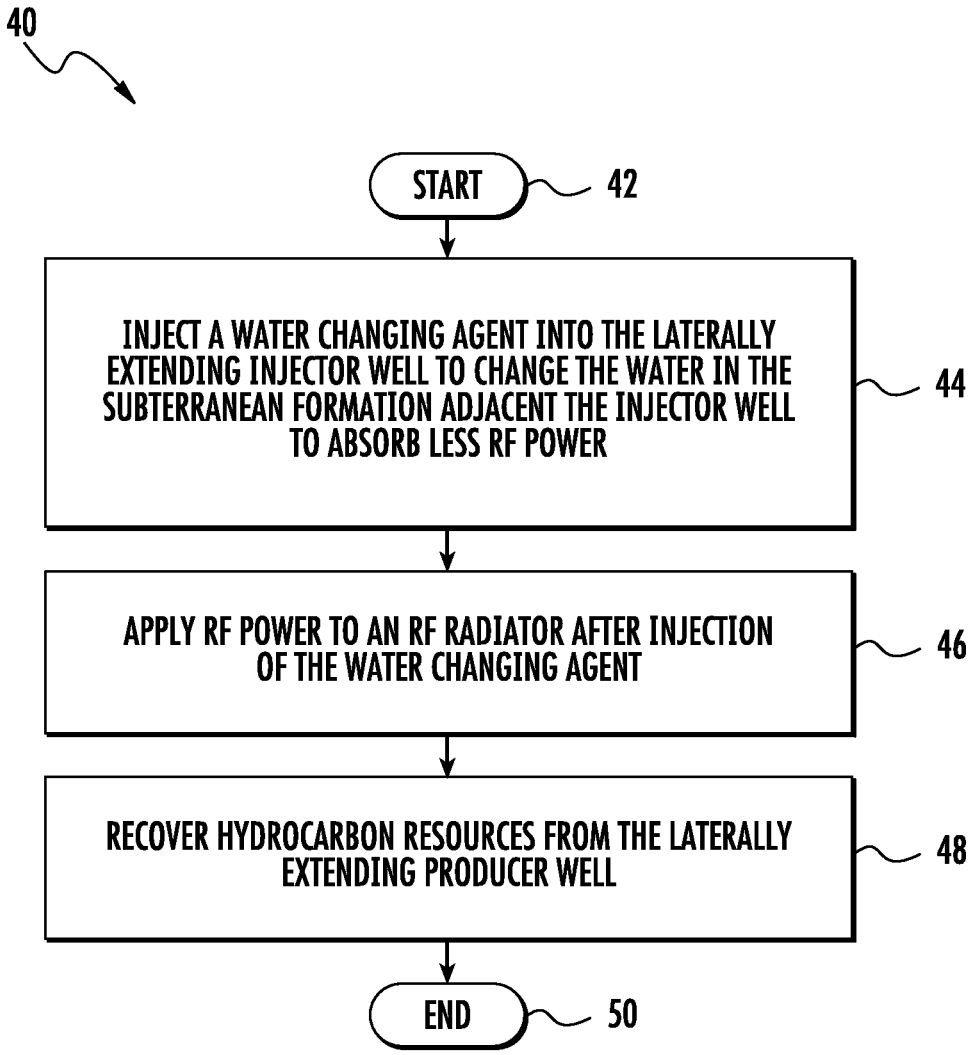
FIG. 1 is a flowchart of a method of processing a hydrocarbon resource in accordance with the invention.
Figure 2:
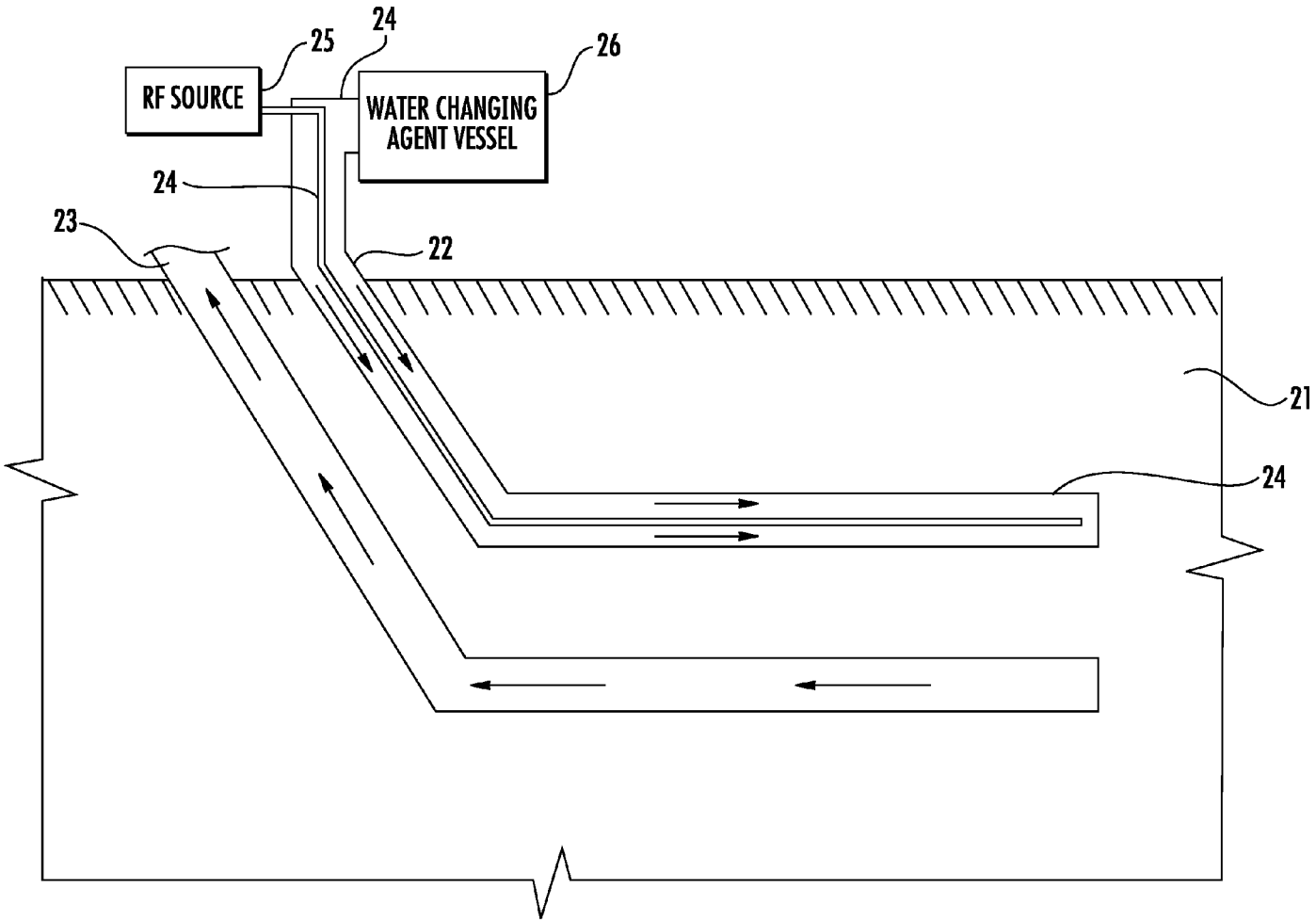
FIG. 2 is a schematic diagram of a system for processing the hydrocarbon resource according to the present invention.

Referring now to the flowchart 40 in FIG. 1 and FIG. 2, a method of processing a hydrocarbon resource in a subterranean formation 21 is illustrated. The subterranean formation 21 includes a laterally extending injector well 22, a laterally extending producer 23 well below the laterally extending injector well. Water and hydrocarbon resources are within the subterranean formation 21.

Beginning at Block 42, the method includes, at Block 44, injecting a water changing agent into the laterally extending injector well 22 to change the water in the subterranean formation 21 adjacent the injector well to absorb less RF power. The water changing agent may be injected from a water changing agent vessel 26 above the subterranean formation 21, for example. The water changing agent may be injected from another source, as will be appreciated by those skilled in the art.

The water changing agent may be particularly advantageous for increasing the penetration of RF power from the RF radiator 24 to increase the rate of hydrocarbon production. More particularly, the water changing agent may increase the prompt (nearly instantaneous) penetration of RF electromagnetic energy into the subterranean formation 21 in a direction radially away from the RF radiator 24. One way to describe the prompt radial penetration away from the RF radiator 24 is to describe the half depth of the prompt radial penetration. For example, an application of RF power to an RF radiator along a length of an RF radiator, in rich Athabasca oil sand having an electrical conductivity of 0.002 mhos/meter typically results in a 50% loss, or half depth of 0.5 meters. In other words, 50% of the RF power penetrates only 0.5 meters from the RF radiator at RF power up. Accordingly, the relationship between prompt radial penetration depth, r, in terms of meters of radius from an axis of the RF radiator 24, and volume loss density, s, in watts per meter$^3$, may be $s=1/r^{5.2}$. It may thus be desirable, for example, to achieve a relationship between radial penetration depth, in terms of meters of radius from the RF radiator axis, and volume loss density in the subterranean formation 21 in watts per meter$^3$, that is $s=1/r^{0.5}$ in rich Athabasca oil sand. The exponent may be defined as the propagation constant.

Neither the sand nor the hydrocarbons appreciably RF heat. The connate pore water is RF heated electromagnetically to heat the associated hydrocarbons conductively. As will be appreciated by those skilled in the art, conductivity, and thus penetration of RF power within the subterranean formation 21, for example, an oil sand formation, is based upon water content, water phase, and water chemistry. In other words, the RF dissipation rate is proportional to the conductivity of the subterranean formation 21. The electrical conductivity may be determined according to the equation $\sigma=kw^2$, where w is the weight in terms of percent of water in the subterranean formation 21, $\sigma$ is the electrical conductivity, and k is a constant of proportionality.

The water changing agent may change the water so that a conductivity of the subterranean formation adjacent the injector well is reduced to below 0.0002 mhos/meter, and more preferably 0.00002 mhos/meter for corresponding radii of at least 10 meters and 30 meters, respectively, for example. In other words, the water changing agent may change the water, and more particularly, the water content to increase RF penetration. The water changing agent may also change the phase of the water to ice or steam to reduce the electrical conductivity and increase the prompt radial penetration depth of the electromagnetic energy.

The water changing agent may be an emulsifying agent, for example. For example, the emulsifying agent may be a glycol or a detergent. Water in an oil or hydrocarbon resource emulsion is an electrical insulator. In other words, the emulsifying agent changes the conductivity of the water within the subterranean formation 21.

Alternatively or additionally, the water changing agent may be a freezing agent, such as, for example, carbon dioxide, and more particularly, compressed carbon dioxide. The carbon dioxide freezes the subterranean formation 21, and water, in the form of ice greatly reduces dissipation RF power, which may greatly increase the prompt penetration of RF heating electromagnetic energy. Of course, other water changing agents may used alone or in combination.

The method further includes, at Block 46, applying RF power to an RF radiator 24 after injection of the water changing agent. However, after the water changing agent is injected, it may be desirable to delay application of RF power to the RF radiator 24 so that the water changing agent may diffuse within the subterranean formation 21. The amount of time to delay may be in the range of 1 to 6 weeks, for example. Of course, the application of RF power may be delayed other time ranges or not delayed at all.

As will be appreciated by those skilled in the art, the water changing agent allows for increased RF power penetration from the RF radiator 24. Accordingly, application of RF power to heat the subterranean formation 21 to a boiling temperature, for example, may not be needed, which, thus, may save energy costs by reducing the size in terms of power of the RF source 25, for example.

The RF power may be applied to the RF radiator 24 from an RF source 25 coupled to the RF radiator, for example, above the subterranean formation 21, to heat the subterranean formation. The RF source 25 may be configured to supply RF power at an antiresonance frequency of the water, for example, about 27 MHz. The RF source 25 may be configured to supply RF power at other frequencies, as will be appreciated by those skilled in the art.

As will be appreciated by those skilled in the art, the water changing agent allows for increased RF power penetration from the RF radiator 24. Accordingly, application of RF power to heat the subterranean formation 21 to a boiling temperature, for example, may not be needed, which, thus, may save energy costs by reducing the size in terms of power of the RF source 25, for example. The water changing agent may be a water changing solvent to dissolve, melt, and/or thin the underground hydrocarbons and change the water. Water changing solvents may include alkane hydrocarbons with 2 to 8 carbon atoms, which include propane and butane. The RF heating may synergistically function to vaporize and drive the solvents and change the water.

At Block 48, the method includes recovering hydrocarbon resources from the laterally extending producer well 23. The method ends at Block 50.

Figure 3:
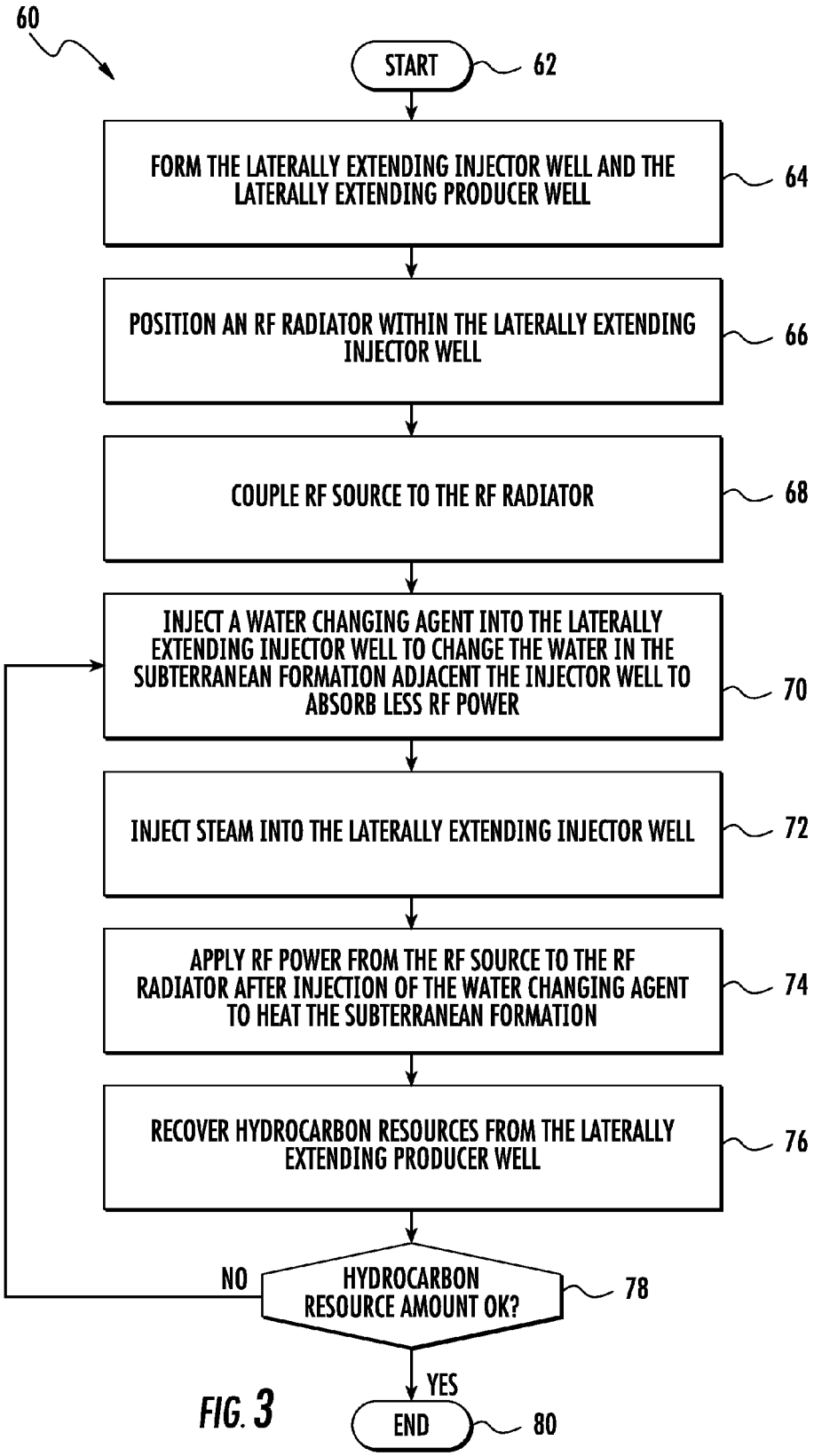
FIG. 3 is a more detailed flowchart of the method of FIG. 1.

Referring now to FIG. 2 and the flowchart 60 in FIG. 3, a more detailed method of processing a hydrocarbon resource in a subterranean formation 21 is illustrated. The subterranean formation 21 includes a laterally extending injector well 22, a laterally extending producer 23 well below the laterally extending injector well. Water is within the subterranean formation 21.

Beginning at Block 62, the method includes forming the laterally extending injector well 22 and the laterally extending producer well 23 (Block 64). The laterally extending injector well 22 and the laterally extending producer well 23 may be formed by drilling, as will be appreciated by those skilled in the art. Moreover, in some embodiments, a liner, for example, a dielectric liner, may be positioned within each of the laterally extending injector and producer wells 22, 23. The method includes, at Block 66 positioning an RF radiator 24 within the laterally extending injector well 22.

An RF source 25 is coupled to the RF radiator 24 (Block 68). The RF source may be coupled above the subterranean formation 21. The RF source 25 may be configured to supply RF power at an antiresonance frequency of the water, for example, about 27 MHz. The RF source 25 may be configured to supply RF power at other frequencies, as will be appreciated by those skilled in the art.

At Block 70, the method also includes injecting a water changing agent into the laterally extending injector well 22 to change the water in the subterranean formation 21 adjacent the injector well to absorb less RF power. The water changing agent may be injecting from a water changing agent vessel 26 above the subterranean formation 21, for example. The water changing agent may be injected from another source, as will be appreciated by those skilled in the art.

The water changing agent may be particularly advantageous for increasing the penetration of RF power from the RF radiator 24. As noted above, for example, application of RF power to an RF radiator along a length of an RF radiator, typically results in a 50% loss, or half depth, at 18 inches. In other words, 50% of the RF power penetrates only 18 inches from the RF radiator. Accordingly, the relationship between penetration depth, in terms of meters of radius from the RF radiator axis, and volume loss density in watts per meter$^3$, may be $1/r^{5.2}$. It may thus be desirable, for example, to achieve a relationship between penetration depth, in terms of meters of radius from the RF radiator axis, and volume loss density in watts per meter$^3$, that is $1/r^{0.5}$.

As will be appreciated by those skilled in the art, conductivity, and thus penetration of RF power within the subterranean formation 21, for example, an oil sand formation, is based upon water content. In other words, the RF dissipation rate is proportional to the conductivity of the subterranean formation 21. The electrical conductivity may be determined according to the equation $\sigma=kw^2$, where w is the weight in terms of percent of water in the subterranean formation 21, σ is the electrical conductivity, and k is a constant of proportionality.

The water changing agent may change the water so that a conductivity of the subterranean formation adjacent the injector well is preferably reduced to below 0.0002 mhos/meter for a radius of at least 10 meters, for example, and more preferably to below 0.00002 mhos/meters for a radius of at least 30 meters. In other words, the water changing agent may change the water, and more particularly, the water content to increase RF penetration.

The water changing agent may be an emulsifying agent, for example. For example, the emulsifying agent may be a glycol or a detergent. Water in an oil or hydrocarbon resource emulsion is an electrical insulator. In other words, the emulsifying agent changes the conductivity of the water within the subterranean formation 21.

Alternatively or additionally, the water changing agent may be a freezing agent, such as, for example, carbon dioxide, and more particularly, compressed carbon dioxide. The carbon dioxide freezes the subterranean formation 21, and water, in the form of ice, greatly reduces dissipation of RF power. Of course, other water changing agents may used alone or in combination.

Additionally, steam may also be injected into the laterally extending injector well 22, as water in the gaseous state greatly reduces dissipation of RF power (Block 72). In some embodiments, in addition to injecting the water changing agent, a vacuum may be drawn via a pump, for example on the laterally extending injector well 22. As will be appreciated by those skilled in the art, water is more mobile than hydrocarbon resources.

The method further includes, at Block 74, applying RF power from the RF source 25 to the RF radiator 24 after injection of the water changing agent to heat the subterranean formation 21. However, after the water changing agent is injected, it may be desirable to delay application of RF power to the RF radiator 24 so that the water changing agent may diffuse within the subterranean formation 21. The amount of time to delay may be in the range of 1 to 6 weeks, for example. Of course, the application of RF power may be delayed other time ranges or not delayed at all.

As will be appreciated by those skilled in the art, the water changing agent allows for increased RF power penetration from the RF radiator 24. Accordingly, application of RF power to heat the subterranean formation 21 to a boiling temperature, for example, may not be needed, which, thus, may save energy costs by reducing the size in terms of power of the RF source 25, for example.

At Block 76, the method includes recovering hydrocarbon resources from the laterally extending producer well 23. Recovering the hydrocarbon resources may include activating a pump, for example, above the subterranean formation 21, to extract the hydrocarbon resources from the laterally extending producer well 23.

At Block 78, a determination is made as to whether certain steps, for example injecting the water changing agent (Block 70), applying RF power (Block 74), and recovering the hydrocarbon resources (Block 76) should be repeated. For example, the above-noted steps may be repeated until a desired amount of hydrocarbon resources have been recovered. If repeating is desired, the method continues from Block 70, otherwise, the method ends at Block 80.

Figure 4:
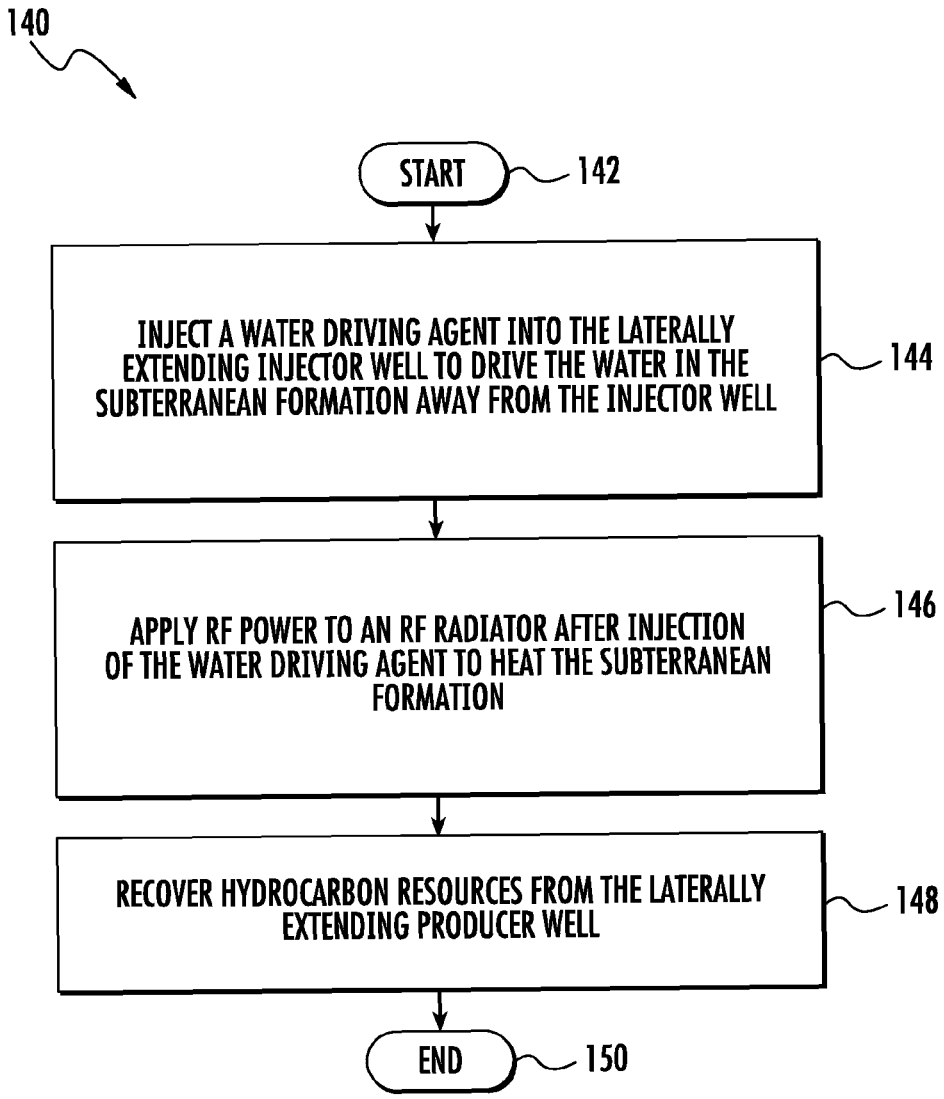
FIG. 4 is a flowchart for the method in accordance with another embodiment of the present invention.
Figure 5:
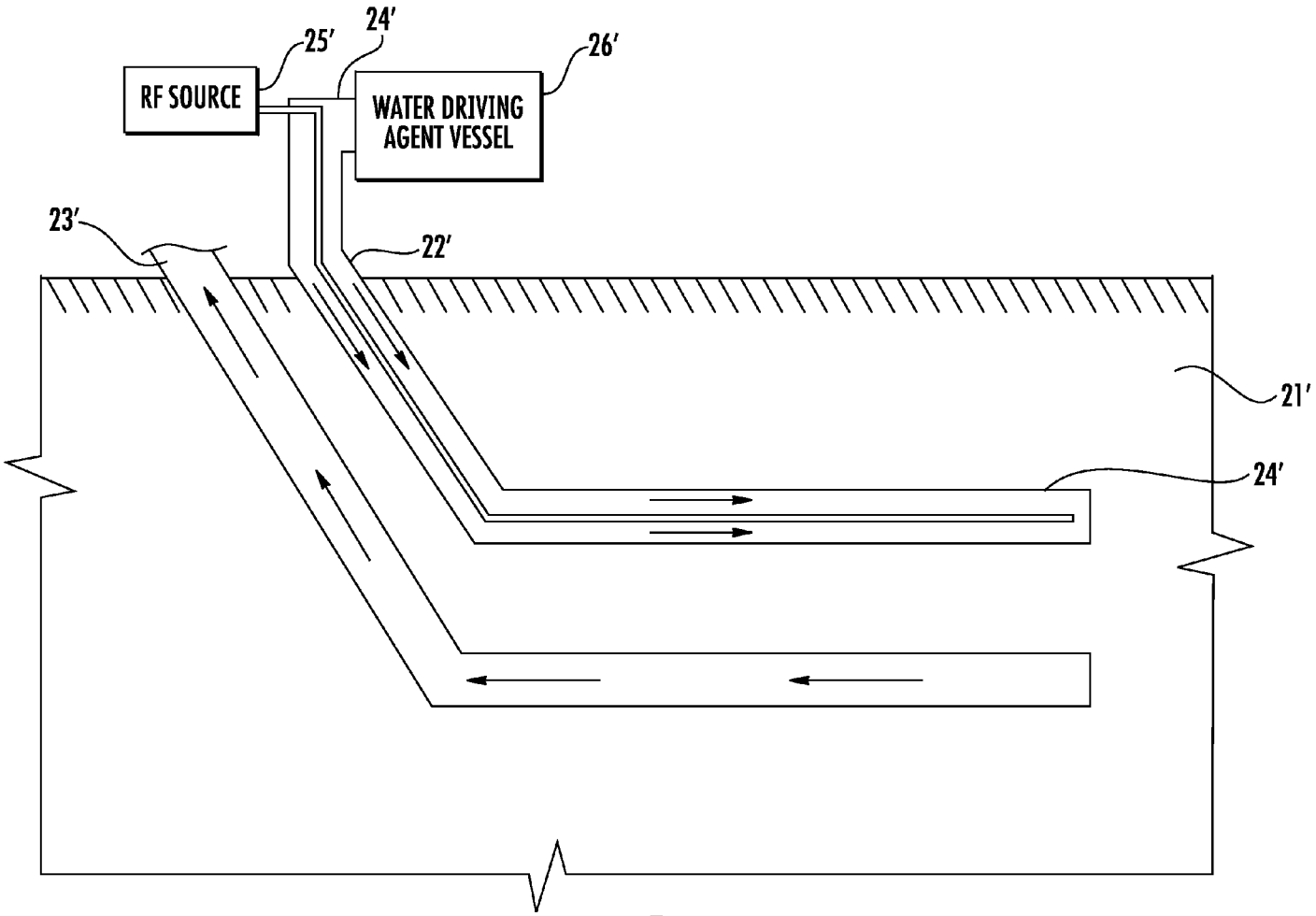
FIG. 5 is schematic diagram a system for processing the hydrocarbon resource according to another embodiment of the present invention.

Referring now to the flowchart 140 in FIG. 4 and to FIG. 5, another method aspect is directed to a method of processing a hydrocarbon resource in a subterranean formation 21'. The subterranean formation 21' includes a laterally extending injector well 22', a laterally extending producer 23' well below the laterally extending injector well. Water is within the subterranean formation 21'.

Beginning at Block 142, the method includes, at Block 144, injecting a water driving agent into the laterally extending injector well 22' to drive the water in the subterranean formation 21' away from the injector well. The water driving agent may be injected from a water driving agent vessel 26' above the subterranean formation 21', for example. The water driving agent may be injected from another source, as will be appreciated by those skilled in the art.

The water driving agent may be particularly advantageous for increasing the penetration of RF power from the RF radiator 24'. For example, application of RF power to an RF radiator along a length of an RF radiator, typically results in a 50% loss, or half depth, at 18 inches. In other words, 50% of the RF power penetrates only 18 inches from the RF radiator. Accordingly, the relationship between penetration depth, in terms of meters of radius from the RF radiator axis, and volume loss density in watts per meter$^3$, may be $1/r^{5.2}$. It may thus be desirable, for example, to achieve a relationship between penetration depth, in terms of meters of radius from the RF radiator axis, and volume loss density in watts per meter$^3$, that is $1/r^{0.5}$.

As will be appreciated by those skilled in the art, conductivity, and thus penetration of RF power within the subterranean formation 21', for example, an oil sand formation, is based upon water content. In other words, the RF dissipation rate is proportional to the conductivity of the subterranean formation 21'. The electrical conductivity may be determined according to the equation $\sigma=kw^2$, where w is the weight in terms of percent of water in the subterranean formation 21', σ is the electrical conductivity, and k is a constant of proportionality.

The water driving agent may drive the water away from the injector well so that a conductivity of the subterranean formation adjacent the injector well is preferably reduced to below 0.0002 mhos/meter, and, more preferably to 0.00002 mhos/meters for corresponding radii of at least 10 meters and 30 meters, respectively, for example. In other words, the water driving agent may drive away the water, and more particularly, reduce the water content to increase RF penetration.

The water driving agent may be a light hydrocarbon, for example, propane and/or butane. As will be appreciated by those skilled in the art, light hydrocarbons, such as, for example, propane, displace water. Light hydrocarbons also advantageously provide synergy in that they may melt the hydrocarbon resources, for example, bitumen, when heated during the application of RF power, for example.

The water driving agent may also be a dry gas. In particular, the water driving agent may be nitrogen, for example. As will be appreciated by those skilled in the art, dry gasses, such as, for example, nitrogen, displace water, are readily available, and are relatively inexpensive. Of course, other water driving agents may used alone or in combination.

The method further includes, at Block 146, applying RF power to an RF radiator 24' after injection of the water driving agent to heat the subterranean formation 21'. However, after the water driving agent is injected, it may be desirable to delay application of RF power to the RF radiator 24' so that the water driving agent may diffuse within the subterranean formation 21'. The amount of time to delay may be in the range of 1 to 6 weeks, for example. Of course, the application of RF power may be delayed other time ranges or not delayed at all.

As will be appreciated by those skilled in the art, the water driving agent allows for increased RF power penetration from the RF radiator 24'. Accordingly, application of RF power to heat the subterranean formation 21' to a boiling temperature, for example, may not be needed, which, thus, may save energy costs by reducing the size in terms of power of the RF source 25', for example.

The RF power may be applied to the RF radiator 24' from an RF source 25' coupled to the RF radiator, for example, above the subterranean formation 21' to heat the subterranean formation. The RF source 25' may be configured to supply RF power at an antiresonance frequency of the water, for example, about 27 MHz. The RF source 25' may be configured to supply RF power at other frequencies, as will be appreciated by those skilled in the art.

As will be appreciated by those skilled in the art, the water driving agent allows for increased RF power penetration from the RF radiator 24'. Accordingly, application of RF power to heat the subterranean formation 21' to a boiling temperature, for example, may not be needed, which, thus, may save energy costs by reducing the size in terms of power of the RF source 25', for example.

At Block 148, the method includes recovering hydrocarbon resources from the laterally extending producer well 23'. The method ends at Block 150.

Figure 6:
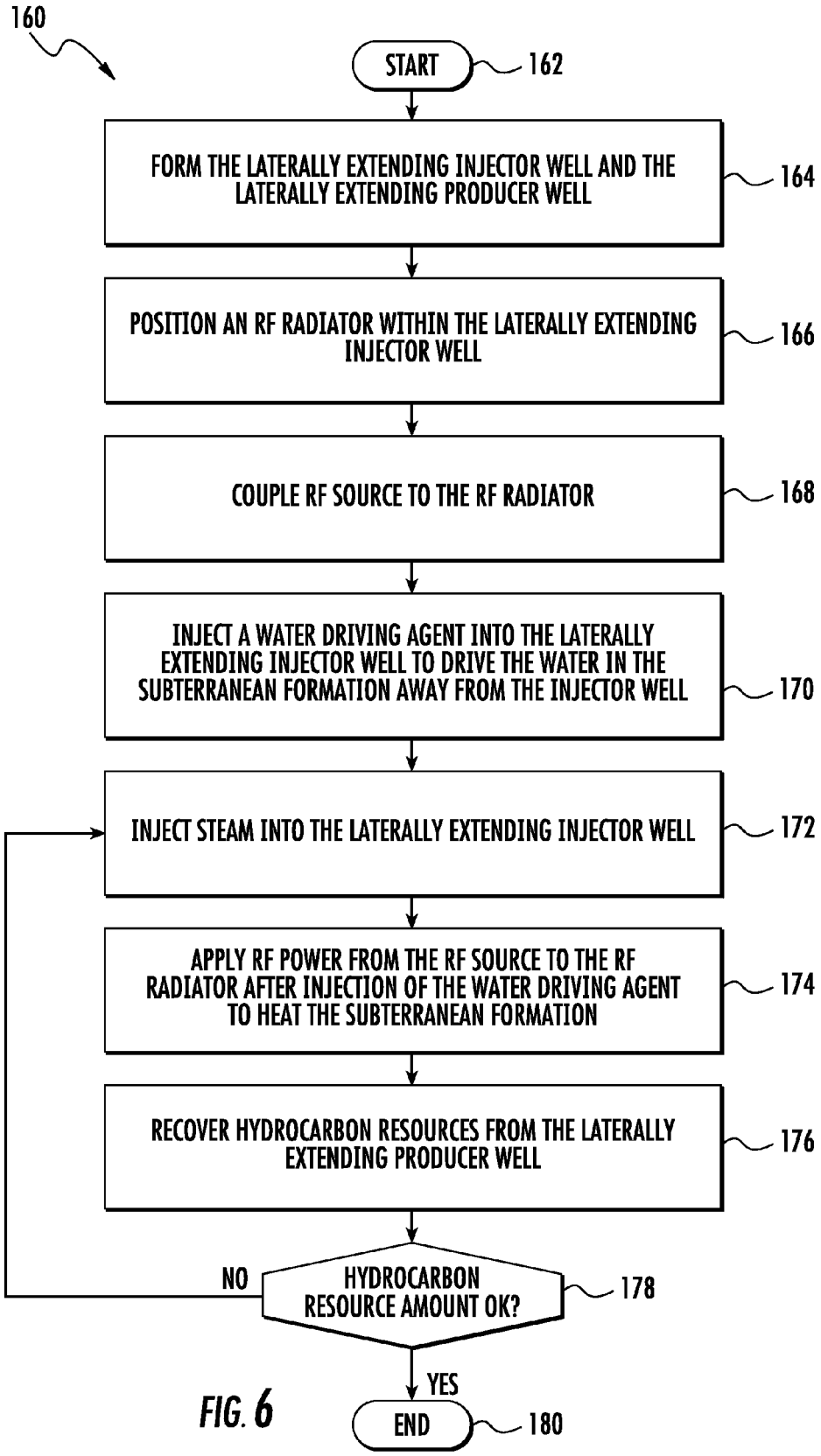
FIG. 6 is a more detailed flowchart of the method of FIG. 4.

Referring now to the flowchart 160 in FIG. 6, and FIG. 5, a more detailed method of processing a hydrocarbon resource in a subterranean formation 21' is illustrated. The subterranean formation 21' includes a laterally extending injector well 22', a laterally extending producer 23' well below the laterally extending injector well. Water is within the subterranean formation 21'.

Beginning at Block 162, the method includes forming the laterally extending injector well 22' and the laterally extending producer well 23' (Block 164). The laterally extending injector well 22' and the laterally extending producer well 23' may be formed by drilling, as will be appreciated by those skilled in the art. Moreover, in some embodiments, a liner, for example, a dielectric liner, may be positioned within each of the laterally extending injector and producer wells 22', 23'. The method includes, at Block 166 positioning an RF radiator 24' within the laterally extending injector well 22'.

An RF source 25' is coupled to the RF radiator 24' (Block 168). The RF source may be coupled above the subterranean formation 21'. The RF source 25' may be configured to supply RF power at an antiresonance frequency of the water, for example, about 27 MHz. The RF source 25' may be configured to supply RF power at other frequencies, as will be appreciated by those skilled in the art.

At Block 170, the method also includes injecting a water driving agent into the laterally extending injector well 22' to drive the water in the subterranean formation 21' away from the injector well 22'. The water driving agent may be injecting from a water driving agent vessel 26' above the subterranean formation 21', for example. The water driving agent may be injected from another source, as will be appreciated by those skilled in the art.

The water driving agent may be particularly advantageous for increasing the penetration of RF power from the RF radiator 24'. As note above, for example, application of RF power to an RF radiator along a length of an RF radiator, typically results in a 50% loss, or half depth, at 18 inches. In other words, 50% of the RF power penetrates only 18 inches from the RF radiator. Accordingly, the relationship between penetration depth, in terms of meters of radius from the RF radiator axis, and volume loss density in watts per meter$^3$, may be $1/r^{5.2}$. It may thus be desirable, for example, to achieve a relationship between penetration depth, in terms of meters of radius from the RF radiator axis, and volume loss density in watts per meter$^3$, that is $1/r^{0.5}$.

As will be appreciated by those skilled in the art, conductivity, and thus penetration of RF power within the subterranean formation 21', for example, an oil sand formation, is based upon water content. In other words, the RF dissipation rate is proportional to the conductivity of the subterranean formation 21'. The electrical conductivity may be determined according to the equation $\sigma=kw^2$, where w is the weight in terms of percent of water in the subterranean formation 21', $\sigma$ is the electrical conductivity, and k is a constant of proportionality.

The water driving agent may drive the water away from the injector well 22' so that a conductivity of the subterranean formation 21' adjacent the injector well is preferably reduced to below 0.0002 mhos/meter for a radius of at least 10 meters, and, more preferably to below 0.00002 mhos/meter for a radius of at least 30 meters, for example. In other words, the water driving agent may drive away the water, and more particularly, reduce the water content to increase RF penetration.

The water driving agent may be a light hydrocarbon, for example, propane and/or butane. As will be appreciated by those skilled in the art, light hydrocarbons, such as, for example, propane, displace water. Light hydrocarbons also advantageously provide synergy in that they may melt the hydrocarbon resources, for example, bitumen, when heated during the application of RF power, for example.

The water driving agent may also be a dry gas. In particular, the water driving agent may be nitrogen, for example. As will be appreciated by those skilled in the art, dry gasses, such as, for example, nitrogen, displace water, are readily available, and are relatively inexpensive. Of course, other water driving agents may used alone or in combination.

Additionally, steam may also be injected into the laterally extending injector well 22', as water in the gaseous state greatly reduces dissipation of RF power (Block 172). In some embodiments, in addition to injecting the water driving agent, a vacuum may be drawn via a pump, for example on the laterally extending injector well 22'. As will be appreciated by those skilled in the art, water is more mobile than hydrocarbon resources.

The method further includes, at Block 174, applying RF power from the RF source 25' to the RF radiator 24' after injection of the water driving agent to heat the subterranean formation 21'. However, after the water driving agent is injected, it may be desirable to delay application of RF power to the RF radiator 24' so that the water driving agent may diffuse within the subterranean formation 21'. The amount of time to delay may be in the range of 1 to 6 weeks, for example. Of course, the application of RF power may be delayed other time ranges or not delayed at all.

As will be appreciated by those skilled in the art, the water driving agent allows for increased RF power penetration from the RF radiator 24'. Accordingly, application of RF power to heat the subterranean formation 21' to a boiling temperature, for example, may not be needed, which, thus, may save energy costs by reducing the size in terms of power of the RF source 25', for example.

At Block 176, the method includes recovering hydrocarbon resources from the laterally extending producer well 23'. Recovering the hydrocarbon resources may include activating a pump, for example, above the subterranean formation 21', to extract the hydrocarbon resources from the laterally extending producer well 23'.

At Block 178, a determination is made as to whether certain steps, for example injecting the water driving agent (Block 170), applying RF power (Block 174), and recovering the hydrocarbon resources (Block 176) should be repeated. For example, the above-noted steps may be repeated until a desired amount of hydrocarbon resources have been recovered. If repeating is desired, the method continues from Block 170, otherwise the method ends at Block 180.

A theory of operation is now described. Warming the subterranean formation 21 thins the hydrocarbon resources increasing flow and hydrocarbon resource recovery. RF power primarily heats the in-situ water, such as, for example, pore water in preference to the associated rock, sand and hydrocarbons in the subterranean formation 21. More particularly, the in-situ water heats the well, and instantaneous radial penetration of the electromagnetic energies may be undesirably shallow, about a 20 inch half depth in 0.002 mhos/meter rich Athabasca oil sand at 6.78 MHz as the slope is $1/r^5$ to $1/r^7$ due to spreading/expansion and dissipation. Although the heating can be extended to any radius desired by reaching the boiling point and growing a steam saturation zone, e.g. "steam bubble", around the well, the associated costs may be relatively high as the oil can drain at temperatures below the boiling point at reservoir conditions. This may be especially true if a solvent, such as, for example, an alkane is used in conjunction with the RF heating. The RF dissipation factor of steam is far less than that of water. The present embodiments advantageously reduce the dissipation factor of the subterranean formation 21 prior to the application of RF power.

Figure 7A:
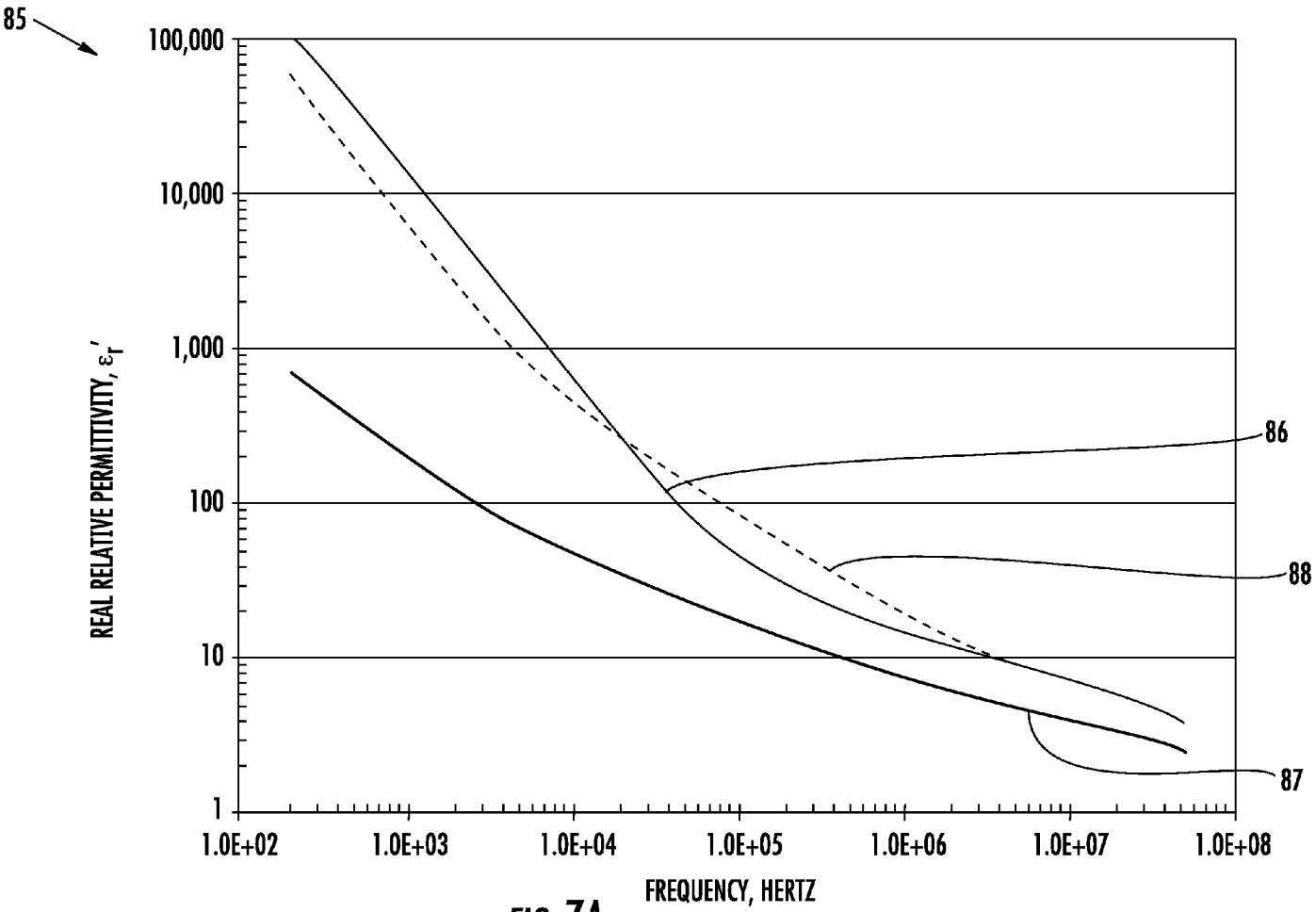
FIG. 7*a* is a graph of the real component of the relative dielectric permittivity of a rich Athabasca oil sand.
Figure 7B:
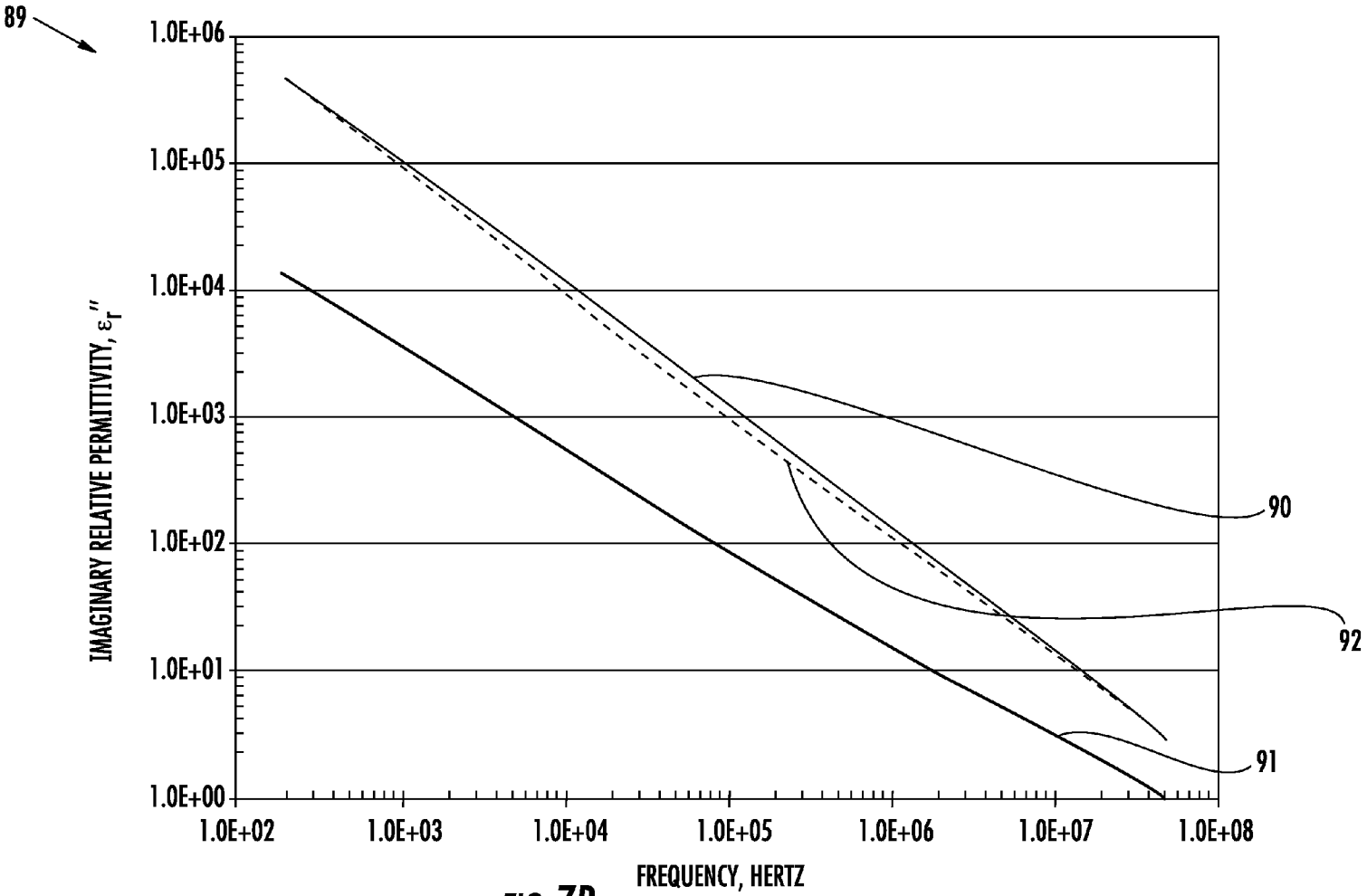
FIG. 7*b* is a graph of the imaginary component of the relative dielectric permittivity of rich Athabasca oil sand.
Figure 7C:
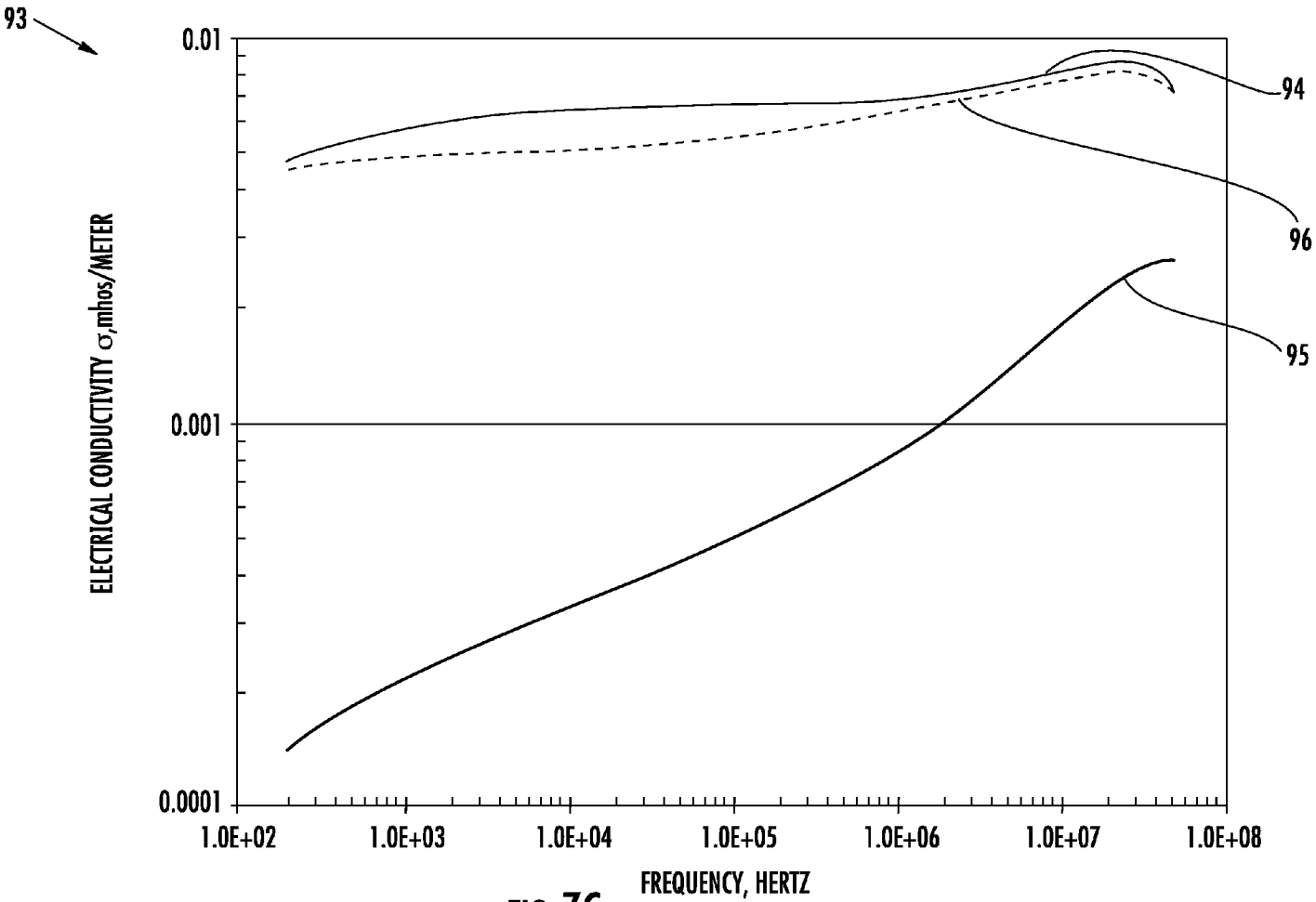
FIG. 7*c* is a graph of the electrical conductivity of rich Athabasca oil sand.
Figure 7D:
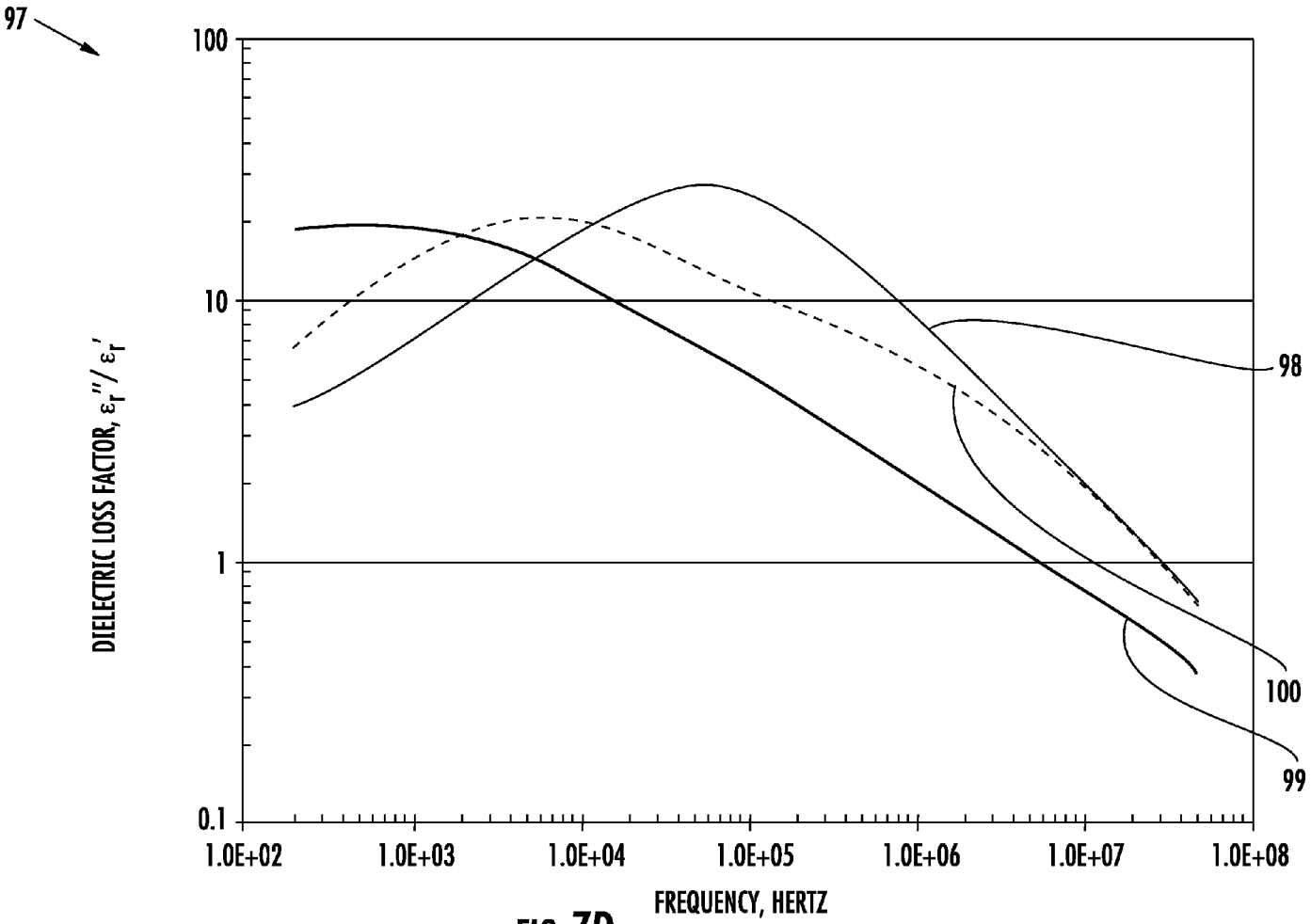
FIG. 7*d* is a graph of the dielectric loss factor of rich Athabasca oil sand.

The electrical characteristics of a sample of Athabasca oil sand hydrocarbon ore are now discussed. The sample oil sand, a rich dark homogenous oil sand, was obtained by core sampling at a depth of 288 meters at a location about 40 miles northwest of Fort McMurray, Canada which is was about 57° north latitude, 110° W longitude. The sample was tested in its native state at about 25° C., tested while frozen at 0° C., and subsequently tested after being thawed at 25° C. to determine changes in electrical characteristics with temperature. The graph 85 in FIG. 7*a* illustrates the measured real part of the relative dielectric permittivity $\in_r'$ of the sample at 25° C. 86, 0° C. 87, and after thawing at 25° C. 88. The graph 89 in FIG. 7*b* shows the measured imaginary part of the relative dielectric permittivity $\in_r''$ of the sample at 25° C. 90, 0° C. 91, and 25° C. 92. The graph 93 in FIG. 7*c* shows the measured electrical conductivity σ in units of mhos/meter of the sample at 25° C. 94, 0° C. 95, and after thawing at 25° C. 96. The graph 97 in FIG. 7*d* shows the measured dielectric loss factor ($\in_r''/\in_r'$) of the sample at 25° C. 98, 0° C. 99, and after thawing at 25° C. 100. Freezing the ore causes a relatively large decrease in electrical conductivity and dielectric loss factor.

The prompt radial penetration depth of the RF heating energy is now further described. This is the initial penetration of RF heating energy radially away from the axis of the antenna when the RF power is first applied. This radial heating gradient may be described by the following equation:

$$S(r)=1/r^{\alpha}=1/r^2+1/r^{\gamma}$$

Where:

α=the radial propagation constant

γ=the dissipative loss factor component r=the range radially away from the antenna bore, in meters S=radial heating gradient as volume loss density in watts/meter$^3$ The $1/r^2$ term may be called the spreading loss, and it arises from the geometric expansion of the magnetic flux as it leaves the antenna, rather than dissipation of the magnetic field as heat. For example, in a vacuum the magnetic field attenuates as $1/r^2$. Term γ arises from the dissipation of the magnetic field into heat in the hydrocarbon ore, typically by magnetic field induction of eddy electric currents in the connate pore water, or by capacitive coupling of electric fields. In one rich Athabasca oil sand analyzed, the electrical conductivity σ was about 0.002 and γ was 3.2.

This may be preferential for reasons of economy, speed and efficiency, including reduced energy costs to heat the hydrocarbon ore uniformly without a gradient in temperature radially away from the antenna. In uniform heating the temperature in the subterranean formation may be relatively the same everywhere and for most of the time. Thus, to accomplish uniform heating, the electrical conductivity σ of the subterranean formation is modified to be exponentially inversely proportional to the radial propagation constant α. Stated mathematically:

$$\sigma(r)=r^{(1/\alpha)}$$

Where:

σ=the electrical conductivity of the hydrocarbon formation at as distance in units of mhos/meter r=the radial distance from the axis of the underground RF heating applicator in meters α=the total radial propagation constant For example, to accomplish more uniform RF heating of a rich Athabasca oil sand subterranean formation having a radial propagation constant α of say 5.2, the radial conductivity profile of the subterranean formation is modified to $\sigma(r)=r^{(1/5.2)}=r^{0.19}$. Thus, according to the present embodiments, the hydrocarbon ore may be modified to be less conductive near the antenna and more conductive further away from the antenna to cause more uniform heating.

Of course, non-uniform radial heating may also be created if desired, such as, for example, reduced heating relatively close to the antenna, and increased heating further away from the antenna, e.g. progressive heating. This may be accomplished by adjusting the radial electrical conductivity profile so that $\sigma(r)=r=r^{(1/k\alpha)}$ where k is greater than 1. Thus, the subterranean formation may be less electrically conductive closer to the antenna, and more electrically conductive further away from the antenna. Increased heating further away from the RF heating applicator may create hydrocarbon driving forces, such as, for example, steam pressure and thermal expansion to displace and mobilize the hydrocarbons for drainage and extraction.

Features and components of the various embodiments disclosed herein may be exchanged and substituted for one another as will be appreciated by those skilled in the art. Many modifications and other embodiments of the invention will also come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of processing a hydrocarbon resource in a subterranean formation comprising a laterally extending injector well, a laterally extending producer well below the laterally extending injector well, and water within the subterranean formation, the method comprising:

injecting a water changing agent into the laterally extending injector well to change the water in the subterranean formation adjacent the injector well to absorb less RF power;

applying RF power to an RF radiator within the injector well after injection of the water changing agent; and recovering hydrocarbon resources from the laterally extending producer well.

2. The method of claim 1, wherein injecting the water changing agent comprises injecting the water changing agent to change the water so that a conductivity of the subterranean formation adjacent the injector well is reduced to below 0.0002 mhos/meter for a radius of at least 10 meters.

3. The method of claim 1, wherein injecting the water changing agent comprises injecting the water changing agent to change the water so that a conductivity of the subterranean formation adjacent the injector well is reduced to below 0.00002 mhos/meter for a radius of at least 30 meters.

4. The method of claim 1, wherein injecting the water changing agent comprises injecting an emulsifying agent.

5. The method of claim 4, wherein injecting the emulsifying agent comprises injecting at least one of a glycol, and a detergent.

6. The method of claim 1, wherein injecting the water changing agent comprises injecting a freezing agent.

7. The method of claim 6, wherein injecting the freezing agent comprises injecting carbon dioxide.

8. The method of claim 1, further comprising coupling an RF source to the RF radiator above the subterranean formation.

9. The method of claim 1, wherein recovering comprises injecting steam into the injector well, and recovering hydrocarbon resources from the laterally extending producer well.

10. A method of processing a hydrocarbon resource in a subterranean formation comprising a laterally extending injector well, a laterally extending producer well below the laterally extending injector well, and water within the subterranean formation, the method comprising:

injecting a light hydrocarbon into the laterally extending injector well to drive water in the subterranean formation away from the laterally extending injector well; and applying RF power to an RF radiator within the laterally extending injector well after injection of the light hydrocarbon; and recovering hydrocarbon resources from the laterally extending producer well.

11. The method of claim 10, wherein injecting the light hydrocarbon comprises injecting the light hydrocarbon to drive the water so that a conductivity of the subterranean formation adjacent the injector well is reduced to below 0.0002 mhos/meter for a radius of at least 10 meters.

12. The method of claim 10, wherein injecting the light hydrocarbon comprises injecting the light hydrocarbon to drive the water so that a conductivity of the subterranean formation adjacent the injector well is reduced to below 0.00002 mhos/meter for a radius of at least 30 meters.

13. The method of claim 10, wherein injecting the light hydrocarbon comprises injecting at least one of propane and butane.

14. The method of claim 10, further comprising coupling an RF source to the RF radiator above the subterranean formation.

15. The method of claim 10, wherein recovering comprises recovering injecting steam into the injector well, and recovering hydrocarbon resources from the laterally extending producer well.

16. A method of processing a hydrocarbon resource in a subterranean formation having water therewithin, the method comprising:

forming a laterally extending injector well in the subterranean formation;

forming a laterally extending producer well below the laterally extending injector well;

injecting a water changing agent into the laterally extending injector well to change the water in the subterranean formation adjacent the injector well to absorb less RF power and so that a conductivity of the subterranean formation adjacent the injector well is reduced to below 0.0002 mhos/meter for a radius of at least 10 meters;

applying RF power to an RF radiator within the injector well after injection of the water changing agent; and recovering hydrocarbon resources from the laterally extending producer well.

17. The method of claim 16, wherein injecting the water changing agent comprises injecting the water changing agent so that the conductivity of the subterranean formation adjacent the injector well is reduced to below 0.00002 mhos/meter for a radius of at least 30 meters.

18. The method of claim 16, wherein injecting the water changing agent comprises injecting an emulsifying agent.

19. The method of claim 18, wherein injecting the emulsifying agent comprises injecting at least one of a glycol, and a detergent.

20. The method of claim 16, wherein injecting the water changing agent comprises injecting a freezing agent.

21. The method of claim 20, wherein injecting the freezing agent comprises injecting carbon dioxide.

22. A method of processing a hydrocarbon resource in a subterranean formation having water therewithin, the method comprising:

forming a laterally extending injector well within the subterranean formation;

forming a laterally extending producer well below the laterally extending injector well;

injecting a water driving agent into the laterally extending injector well to drive water in the subterranean formation away from the laterally extending injector well so that a conductivity of the subterranean formation adjacent the injector well is reduced to below 0.0002 mhos/meter for a radius of at least 10 meters; and applying RF power to an RF radiator within the laterally extending injector well after injection of the water driving agent; and recovering hydrocarbon resources from the laterally extending producer well.

23. The method of claim 22, wherein injecting the water driving agent comprises injecting the water driving agent so that the conductivity of the subterranean formation adjacent the injector well is reduced to below 0.00002 mhos/meter for a radius of at least 30 meters.

24. The method of claim 22, wherein injecting the water driving agent comprises injecting a light hydrocarbon.

25. The method of claim 24, wherein injecting the light hydrocarbon comprises injecting at least one of propane and butane.

26. The method of claim 22, wherein injecting the water driving agent comprises a dry gas.

27. The method of claim 26, wherein injecting the dry gas comprises injecting nitrogen.

28. A method of processing a hydrocarbon resource in a subterranean formation comprising a laterally extending injector well, a laterally extending producer well below the laterally extending injector well, and water within the subterranean formation, the method comprising:

injecting a dry gas into the laterally extending injector well to drive water in the subterranean formation away from the laterally extending injector well; and applying RF power to an RF radiator within the laterally extending injector well after injection of the dry gas; and recovering hydrocarbon resources from the laterally extending producer well.

29. The method of claim 28, wherein injecting the dry gas comprises injecting the dry gas to drive the water so that a conductivity of the subterranean formation adjacent the injector well is reduced to below 0.0002 mhos/meter for a radius of at least 10 meters.

30. The method of claim 28, wherein injecting the a dry gas comprises injecting the dry gas to drive the water so that a conductivity of the subterranean formation adjacent the injector well is reduced to below 0.00002 mhos/meter for a radius of at least 30 meters.

31. The method of claim 28, wherein injecting the dry gas comprises injecting nitrogen.

32. The method of claim 28, further comprising coupling an RF source to the RF radiator above the subterranean formation.

33. The method of claim 28, wherein recovering comprises recovering injecting steam into the injector well, and recovering hydrocarbon resources from the laterally extending producer well.

* * * * *